US005672143A

United States Patent [19]

Ish, III

[11] Patent Number: 5,672,143

[45] Date of Patent: Sep. 30, 1997

[54] EXERCISE STATION FOR LEG EXERCISES

[75] Inventor: A. Buell Ish, III, Redmond, Wash.

[73] Assignee: Vectra Fitness, Inc., Redmond, Wash.

[21] Appl. No.: 679,079

[22] Filed: Jul. 12, 1996

Related U.S. Application Data

[63] Continuation-in-part of Ser. No. 597,522, Feb. 2, 1996.

[51] Int. Cl.[6] ..... A03B 23/04

[52] U.S. Cl. ..... 482/99; 482/137; 482/138; 482/208

[58] Field of Search ..... 482/94–103, 112, 482/113, 129, 130, 133, 135–138, 903, 908

[56] References Cited

U.S. PATENT DOCUMENTS 4,678,185 7/1987 Mahnke ..... 482/137

*Primary Examiner*—Stephen R. Crow

*Assistant Examiner*—John Mulcahy

*Attorney, Agent, or Firm*—Seed and Berry LLP

[57] ABSTRACT

An exercise station for use in performing leg exercises has a bench on the front of which an exercise unit with leg engagement arms and a load unit connected to a loaded cable are swing mounted on a horizontal swing axis. A two-bar linkage is pivotally connected to the units and has over-center extended and folded positions when the exercise unit is in raised and lowered exercise positions, respectively, whereby exercising swing movement of the exercise unit also swing moves the load unit by way of the linkage.

21 Claims, 4 Drawing Sheets

EXERCISE STATION FOR LEG EXERCISES

CROSS REFERENCE

This application is a continuation-in-part of my copending application Ser. No. 08/597,522, filed Feb. 2, 1996.

TECHNICAL FIELD

The present invention relates to exercise machines of the type wherein a weight stack or other load is interconnected by a cable system to exercise apparatus such as to provide a predetermined resistance to performance of an exercise with the apparatus. More particularly, the invention relates to an exercise station at which leg exercises can be performed such, for example, as leg curl and leg extension exercises.

BACKGROUND OF THE INVENTION

Heretofore, it has been known to swing mount at the front of a bench an exercise unit having a pair of oppositely projecting padded arms at its lower end for leg engagement to swing the exercise unit outwardly and upwardly in opposition to a loaded cable connected to the exercise unit. When performing a leg extension exercise with such a unit in a lowered starting position the exercising person is seated and engages the back of the padded arms with the front of his (her) ankles and swings his (her) legs forwardly at the knees to swing the exercise unit outwardly (forwardly) in opposition to the load on the cable. It has also been known to provide an adjustment mechanism for the exercise unit by which it could be raised to an alternative elevated starting position at which the padded arms are higher than the bench for performance of a leg curl exercise in which the exercising person lies face down on the bench and pushes upwardly with the back of his (her) ankles against the padded arms to swing the exercising unit rearwardly in opposition to the loaded cable. In the past the adjustment mechanism for changing from one of these exercise starting positions to the other one has required removal and reinsertion of an adjustment pin or some other relatively inconvenient manipulation. Alternatively, some exercise machines have had two sets of arms at different elevations for leg engagement rather than adjusting the elevation of a single set.

SUMMARY OF THE INVENTION

The present invention aims to provide an exercise station or machine having a simplified adjustable mechanism for changing back and forth between a leg extension mode and a leg curl mode and utilizing only one set of arms for leg engagement. This is accomplished for example by swing mounting a load unit at the same swing axis as that of an exercise unit and interconnecting the units by a two-bar linkage spaced from the swing axis such that the linkage is extended when in a raised leg curl starting position and is folded when in a lowered leg extension starting position. The linkage is in an over-center condition when in both of its starting positions to couple the units together to then move the units in unison, and is spring loaded against release from these positions. A lever is connected to the linkage by which the linkage can be easily manually manipulated to change the setting of the apparatus from one exercising position to the other one. Such an exercise device may be used as one of the stations in the multi-station exercise machine disclosed in my previously identified copending application.

DETAILED DESCRIPTION OF THE INVENTION

Figure 1:
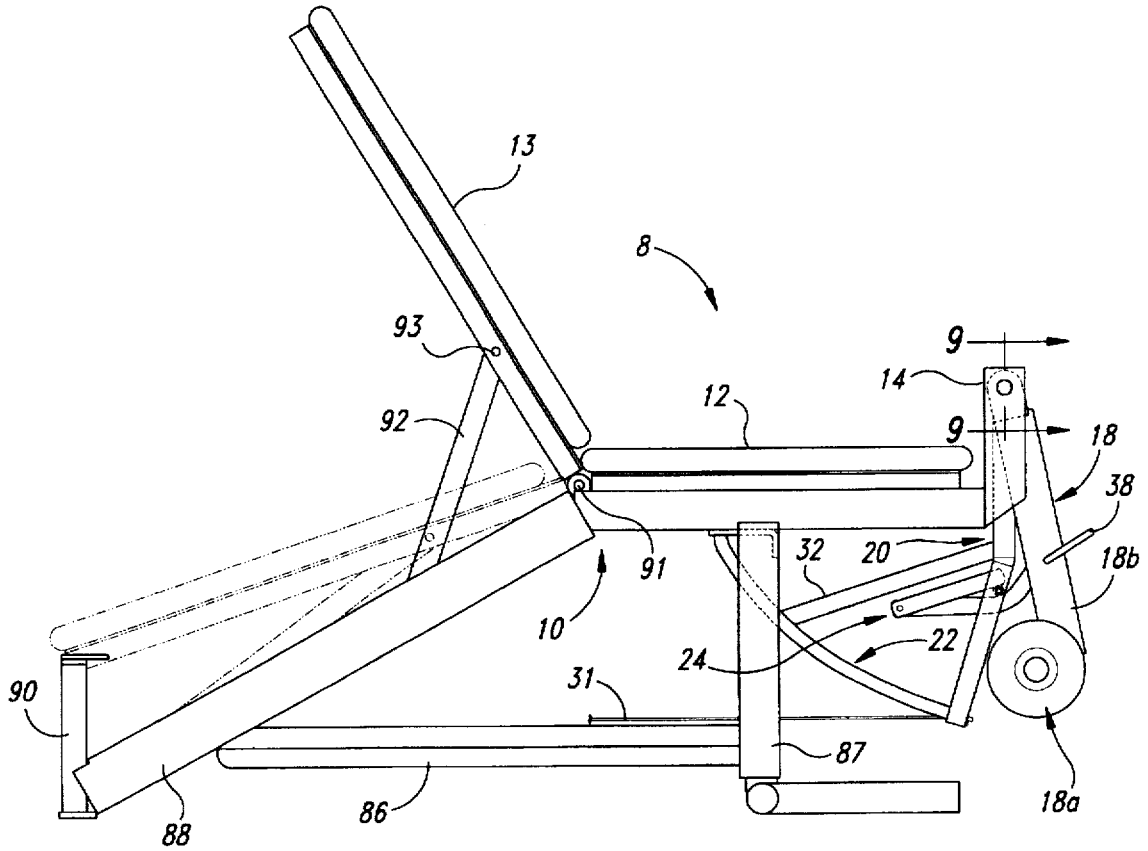
FIG. 1 is a side elevational view of the exercise station of the present invention shown with its apparatus in position for the performance of a leg extension exercise.

Referring to the drawings, it is seen that the exercise station 8 of the present invention has a body support with a frame 10 for a seat section 12 and adjustable back section 13 jointly providing a bench when the back is adjusted to a generally horizontal position. At the front of the seat section there is an upwardly projecting post 14 which is laterally centered. This post may comprise a forwardly opening channel with a pair of aligned bearings 16 mounted at opposite sides in bores adjacent the upper end. Swing supported from these bearings 16 are an exercise unit 18 having padded arms **18*a* at its lower end, and a load unit 20 with a cable guiding cam 22 at its lower end. These exercise and load units 18, 20 are interconnected by a two-bar linkage 24 having link bars 24*a*, 24*b***.

The exercise unit 18 comprises a rearwardly opening channel member **18*b* having a pair of forks 18*c* mounted at one end and a tubular cross-bar 18*d* at its other end on which cylindrical pads 18*e* are sleeved to form the arms 18*a*. The load unit 20 has a short cylinder 20*a* at its upper end which is closed at its ends by round inserts 20*b*. Bolts 26 extend through the bearings 16 and aligned bores in the forks 18*c* and centers of the inserts 20*b* to provide a horizontal swing mounting for the exercise and load units 18, 20. The bores in the forks 18*c* or the inserts 20*b* are threaded to retain the bolts 16**.

Extending in side-by-side relation from weld connections to the short cylinder **20*a* are a pair of parallel members having upper sections 20*c* separated by a gap 20*d*, and expanding at intermediate shoulder sections 20*e* to bottom sections 20f providing an elongated opening 20g therebetween. At their lower ends the bottom sections 20f are weld connected to the ends of a U-shaped spacer 28 formed with a keyhole slot 30 facing forwardly and continuing around the bottom of the spacer 28 so as to be rearwardly exposed to the cam 22. This cam comprises a cam strip 22a which is welded at its forward end to the spacer 28 and is vee-shaped in cross-section to provide a downwardly facing guide track for receiving a load cable 31 having a forward terminal ball fitting into the keyhole slot 30 through its eye. The cam strip 22a extends rearwardly for a short distance at right angles to the bottom sections 20f and then arches upwardly as it continues to its rear end. A brace 32 slopes upwardly from a weld connection to cam strip 22a into the lower portion of the gap 20d for a weld connection to the upper sections 20c. When the load unit is swung downwardly to its rearmost position the rear end of the cam strip engages the frame 10** beneath the seat.

The bars 24a, 24b of the linkage 24 are pivotally connected together by a pivot pin 34 and are respectively pivotally connected at their opposite ends to the exercise and load units 18, 20. More particularly, the linkage bar 24a is welded to a collar 35a in turn fixed by a pin onto a cross-rod 35 which bridges the channel member 18b of the exercise unit and is rotatively mounted in aligned bores in the channel member 18b to function as a pivot. The linkage bar 24b has a sleeve 24c thereon which is journaled on a pivot pin 36 which bridges the longitudinal opening 20g and is fixed at its ends to the bottom sections 20f of the load unit 20 near the shoulder sections 20c. Thus it is seen that the linkage has a pivot 34 at its elbow and has pivots 35–36 at its exercise unit and load unit ends, respectively. The linkage bar 24a is preferably formed with a bend offset from a line between the pivots 34–35.

Referring to the cross-rod 35, it will be noted that it continues at one end beyond the channel member 18b and is bent to form an exposed lever 38 which thereby has a rigid connection to the linkage bar 24a via the cross-rod 35. The linkage bar 24a is formed with a hole 24d spaced a relatively short distance from the cross-rod 35 in the general direction of the elbow pivot 34, and the channel member 18b has a cross-pin 40 spaced toward the swing support for the exercise unit 18 from the cross-rod 35. A tension spring 42 is pivot connected by a hook at one of its ends to the cross-pin 40, and is pivot connected by a hook at its other end to a hook on one end of a rigid wire link 44. The other end of this wire link has a hook fitting through the hole 24d in the linkage bar 24a to engage the bar.

Figure 4:
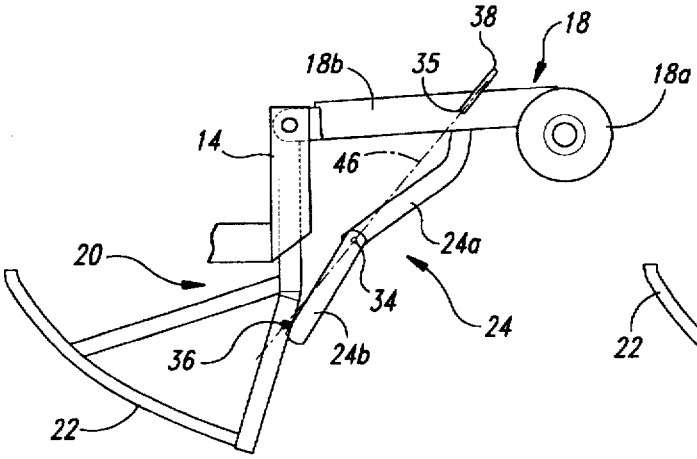
FIG. 4 is a fragmentary side elevational view of the apparatus with its linkage pivots aligned in an on-center position beyond which the elbow pivot of the linkage is positioned in an over-center position when the apparatus is in its FIG. 3 operating position.
Figure 5:
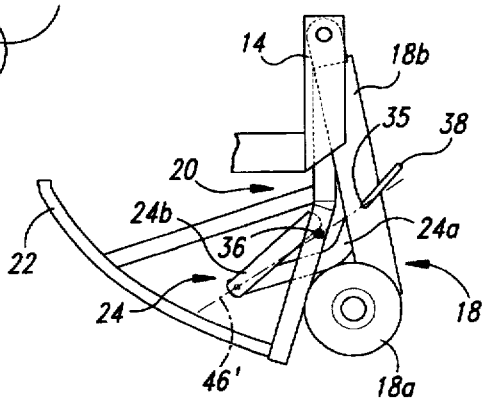
FIG. 5 corresponds to FIG. 4 in showing the linkage pivots aligned in an on-center position beyond which the elbow pivot of the linkage is positioned in an over-center position when the apparatus is in its FIG. 2 operating position.
Figure 6:
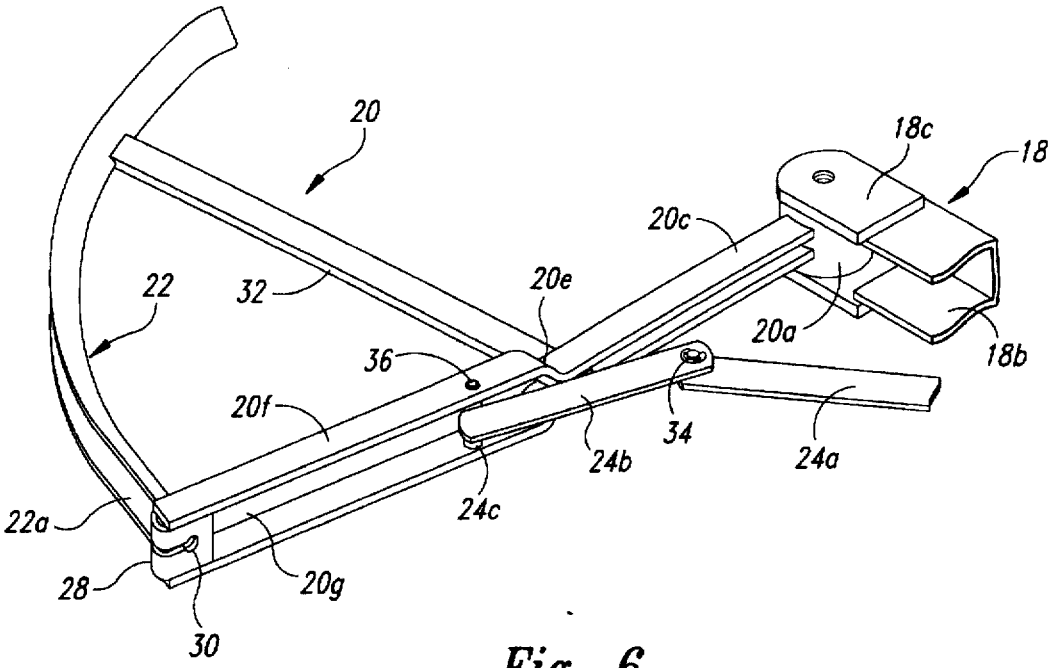
FIG. 6 is a perspective view of the load unit with part of the associated exercise unit and linkage also being shown.
Figure 7:
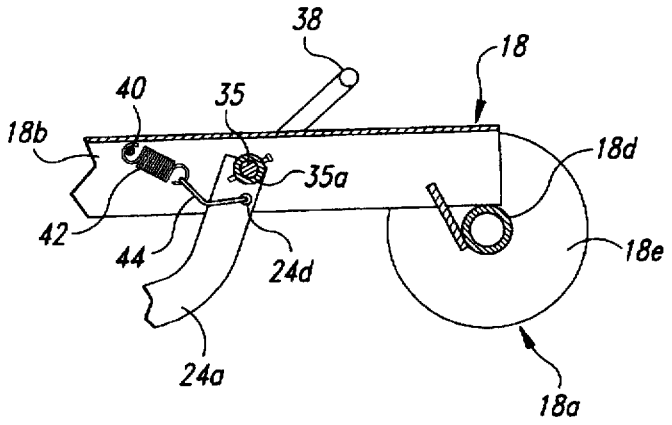
FIG. 7 is a detail sectional view taken in elevation along the longitudinal center line of the exercise unit showing the position of the spring and related parts when the exercise unit is in raised position.
Figure 8:
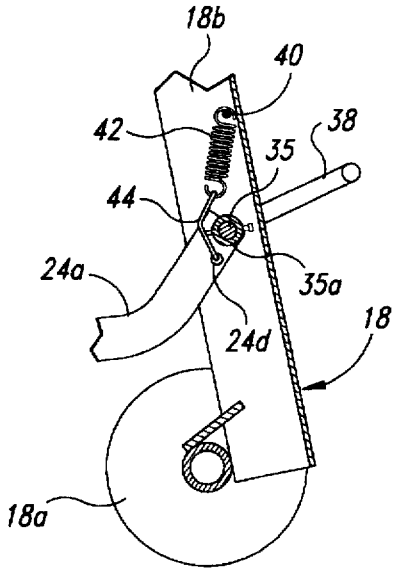
FIG. 8 is a view like FIG. 7 showing the spring and related parts when the exercise unit is in lowered position.
Figure 9:
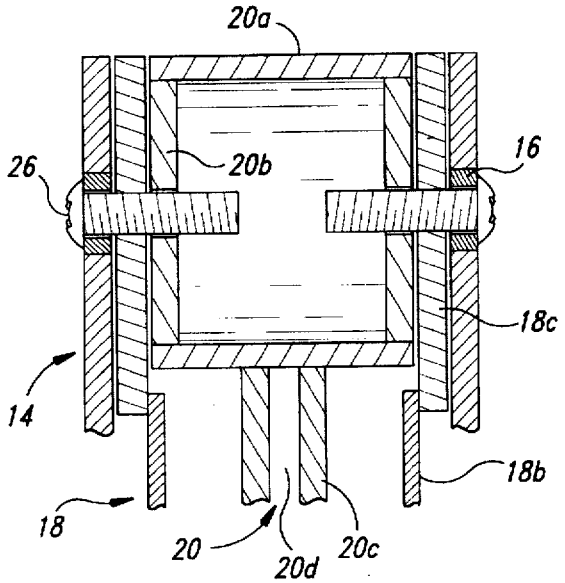
FIG. 9 is a detail vertical sectional view taken as indicated by line 9—9 in FIG. 1.

The exercise unit 18 has two operating positions, a lowered position (FIG. 2) for performance of the leg extension exercise, and a raised position (FIG. 3) for performance of the leg curl exercise. When the exercise unit 18 is in its raised position the linkage 24 is in an extended condition, and when the exercise unit is in its lowered position (FIG. 1) the linkage 24 is in a folded position. In both of these positions the linkage is in an over-center position, i.e., the elbow pivot 34 has moved past a straight line (phantom lines 46–46' in FIGS. 4–5) passing through the outer end pivots 35–36 of the linkage bars. Also, in both of these positions, in order to move the elbow pivot 34 back across the respective line 46 or 46' between the pivots 35–36 to swing the exercise unit 18 from one of its two exercise positions to the other one, the tension spring 42 is stretched.

Figure 2:
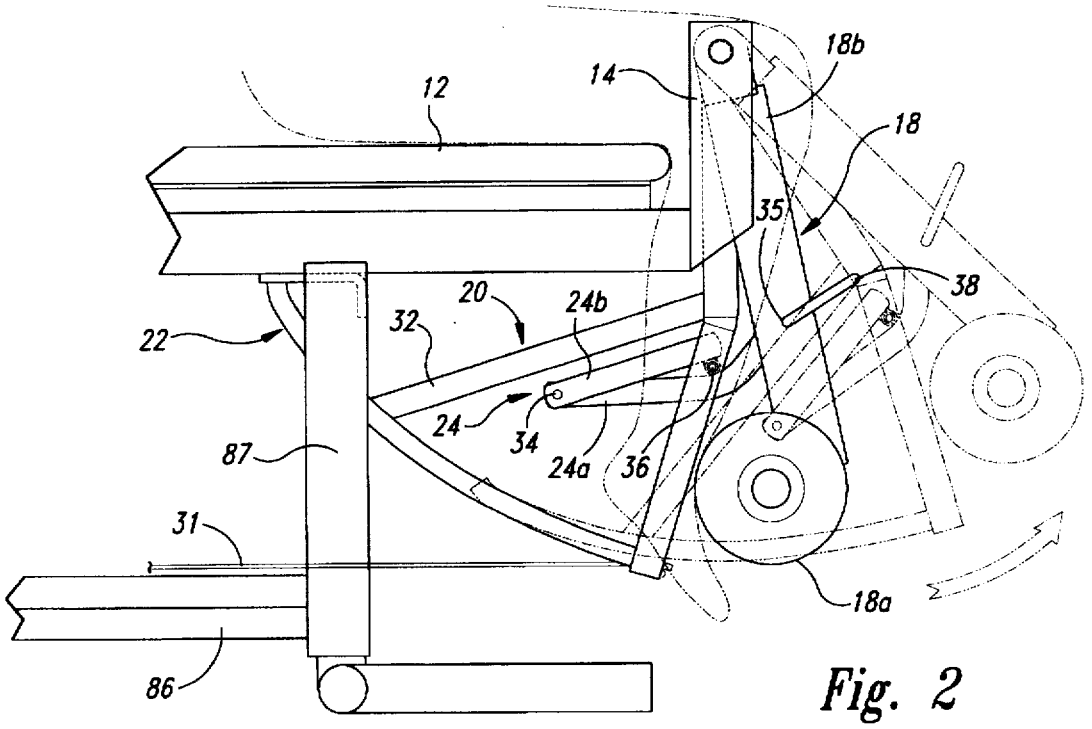
FIG. 2 is a fragmentary side elevational view to an enlarged scale of the station illustrating performance of the leg extension exercise.

By the time that the elbow pivot 34 has swung rearwardly through the longitudinal opening 20g while the exercise unit is being lowered, the spring 42 has been stretched a maximum amount so that as the elbow pivot moves past center (past the phantom line 46' in FIG. 5) the biased spring 42 takes over and urges the linkage to swing further to the rear. However, such rearward movement is limited by engagement of the inside edge of the bend in the linkage bar 24a with the sleeve 24c at pivot 36 as can be seen in FIG. 2.

When the exercise unit 18 is in its lowered position the folded linkage 24 locks the locking unit 20 to the load unit. Thus, when the leg extension exercise is being performed upward swinging movement of the exercise unit 18 responsive to forward acting leg pressure exerted on the back of the padded arms 18a causes the cable 31 to be pulled forwardly in opposition to a weight stack or other load.

When it is desired to swing the exercise unit 18 upwardly to its raised position for performing the leg curl exercise the lever 38 is manually swung in the upward direction from its over-center position in opposition to the spring 42 until the elbow pivot 34 is swung forwardly past center (past line 46 in FIG. 4) so that the spring will then assist in manually raising the exercise unit to its raised position. Then when the leg curl exercise is performed, the linkage is tensioned but spring bias prevents the elbow pivot 34 from moving forwardly past center (past line 46 in FIG. 4). Hence, as the exercise unit is swung rearwardly during the leg curl exercise, the linkage 24 causes the load unit to be responsively swung such as to tension the cable in opposition to the weight stack. When it is desired to lower the exercise unit, the lever 38 is swung rearwardly in opposition to the spring 42, thereby moving the elbow pivot from its over-center position forwardly past center. Hence, it is seen that by manual manipulation of the lever 38, the exercise unit 18 can be moved between its two exercise positions while remaining connected to the load unit 20 by the linkage 24.

Figure 10:
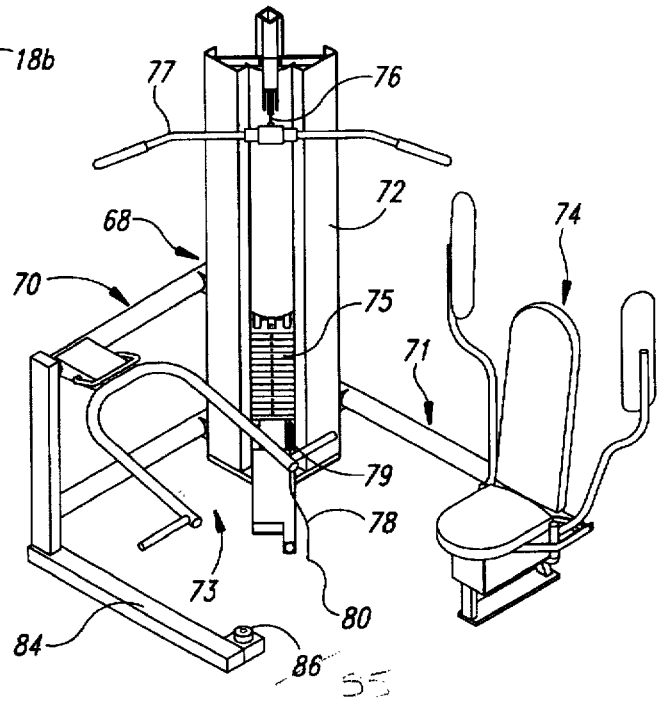
FIG. 10 is a perspective view of a compact multi-station exercise machine with which the present exercise station may be incorporated.
Figure 11:
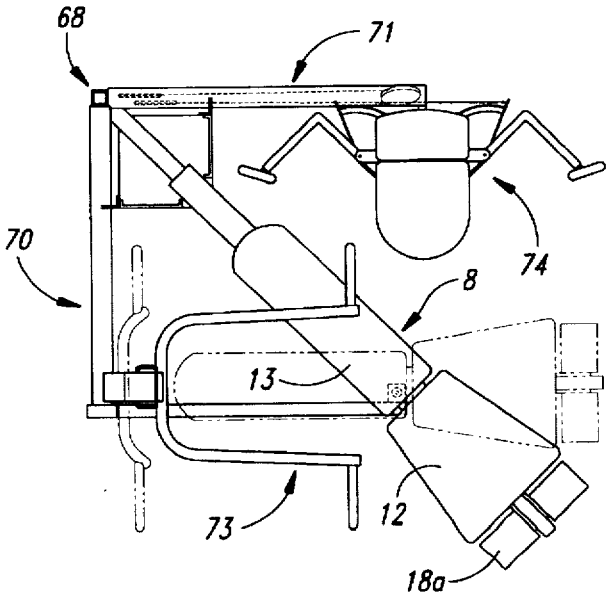
FIG. 11 is a layout illustrating in full lines present exercise station in position for use of its exercise apparatus, and showing in broken lines the present exercise station in position for its bench to be used in conjunction with the press station.

In my previously identified copending application there is disclosed a compact multi-station exercise machine in which the present invention may be used. Referring to FIGS. 10 and 11, this compact machine incorporates a corner frame 68 from which extend right and left frame extensions 70–71 as wings from a mast 72. "Right" and "left" designate directions as viewed by a person with his (her) back facing the corner frame 68. The right frame extension 70 supports a press exercise station 73 and the left frame extension 71 supports a butterfly exercise station 74. A standard weight stack 75 is supported on the base of the corner frame 68. This weight stack 75 is connected to the exercise stations 73–74 by a reeving system which provides a top cable 76 connected to a pull bar 77 and the weight stack, and provides a second cable 78 related to the top cable by a double floating pulley (not shown) and having one of its ends extending under a pulley 79 at the bottom of the frame 68 and forwardly to an exposed terminal ball 80. A stop ball (not shown) is spaced behind the connector ball to engage the pulley 79 to space the connector ball forwardly of the frame 68 for ease of connection to a keyhole connector (not shown) on the cable 31 of an exercise station such as that disclosed in the present application.

Figure 3:
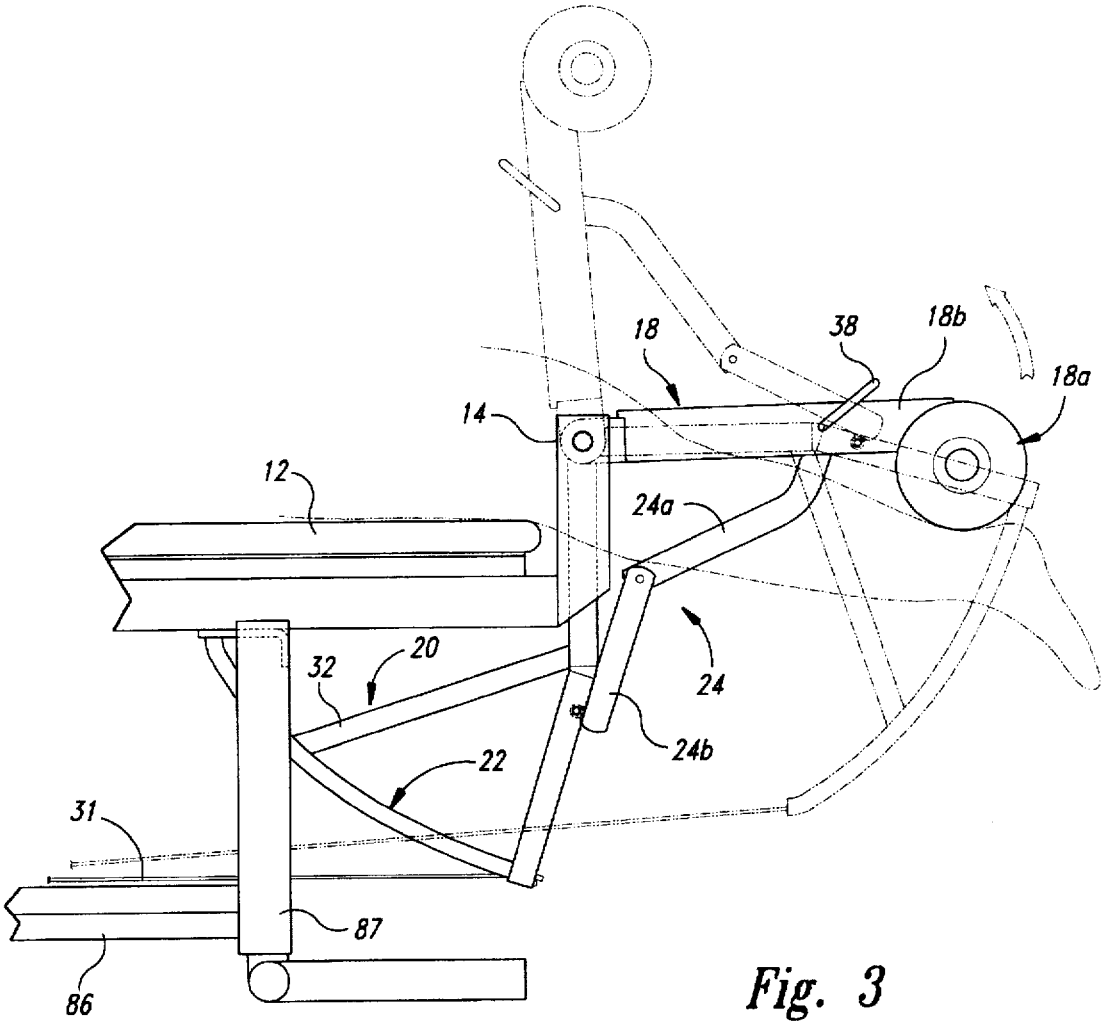
FIG. 3 is a fragmentary side elevational view of the station illustrating performance of the leg curl exercise.

The right frame extension 70 has a forwardly extending outrigger 84 having an offset upwardly projecting roller 85 adjacent its fee end. This roller 85 is positioned to fit into a downwardly facing channel track presented by a longitudinal brace 86 on the frame 10. The brace 86 extends horizontally between a front leg section 87 and a rearwardly sloping leg section 88 in the form of a channel extending from the back of the seat section 12 to a rear handle in the form of an upwardly projecting post 90. The back section 13 is swing-mounted at a pivot 91 to swing rearwardly from a generally upright position (full line position in FIG. 1) to provide back support for an exercising person seated on the seat section 12, to a lowered downwardly sloping position shown by broken lines in FIG. 1. The latter position is commonly used by an exercising person lying face down on the seat section 12 and back section 13 with the back of his (her) ankles engaging the underside of the padded arms 18*a* for performing leg curl exercise when the exercise unit 18 is in raised position as indicated in FIG. 3. Swing adjustment of the back section 13 is accomplished by an adjustment strut 92 extending from a pivot 93 on the back section 13 to assume selected positions interfitting by a foot with a series of holes (not shown) along the center of the sloping rear leg section 88.

For operation of the exercise station 8, the frame 10 is positioned diagonally in front of the mast 72 shown by the full line position in FIG. 11, and the load cable 31 is connected to the cable 78 extending forwardly from the base of the mast. The frame 10 can be repositioned in front of the press station 73 as indicated by its broken line position in FIG. 11, using the roller 85 and related track of the brace 86 as positioning guides. When the frame 10 is in this alternative position, the back section 13 can be adjusted to a downwardly sloped condition, a horizontal condition, an upwardly sloped position, or an upright position, for supporting an exercising person while respectively performing a decline press, bench press, incline press or shoulder press exercise.

It will be understood that the exercise station of the present invention in not limited for use with the exercise machine shown in FIGS. 10 and 11, but can be connected to its own weight stack or other suitable load as an independent exercise machine, or used in conjunction with another exercise machine. It will also be understood that additional leg exercises can be performed with the described apparatus such, for example, as a leg curl exercise in which the exercising person is standing facing rearwardly and engages the back of one of his (her) legs with the adjacent arm 18*a* when the exercise unit 18 in its lowered position.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. An exercise station comprising:

a support frame;

a load unit and an exercise unit swing-mounted on said support frame for relative swinging movement, said exercise unit having first and second exercise positions for performing respective first and second exercises each causing swinging of said exercise unit in the same exercising direction; and said load unit having different positions relative to said exercise unit when said exercise unit is in its first and second exercise positions;

a linkage constantly interconnecting said units such that when said exercises are performed, swinging movement of said exercise unit in said exercising direction causes like swinging movement of said load unit, said linkage having an extended condition when said first exercise is performed and having a folded position when said second exercise is performed whereby said load unit has said different positions relative to said exercise unit.

2. An exercise station according to claim 1 in which said load unit and exercise unit are swing-mounted on said support at the same swing axis.

3. An exercise station according to claim 2 in which said support frame provides a body support and in which said swing axis is horizontal and elevated.

4. An exercise station according to claim 2 in which said linkage is spaced from said same swing axis and has first and second links pivotally connected together at an elbow pivot and pivotally connected respectively to said exercise unit and load unit at first and second pivots.

5. An exercise station according to claim 4 in which a tension spring is connected to one of said links and to one of said units such as to resist relative movement between said units when said exercise unit is in its said exercise positions.

6. An exercise station according to claim 4 in which a lever is rigidly connected to said first link at its pivotal connection with said exercise unit.

7. An exercise station according to claim 6 in which a tension spring is connected between said first link and exercise unit at locations spaced from said same swing axis.

8. An exercise station according to claim 4 in which said elbow pivot is in an over-center position relative to respective imaginary straight lines through said first and second pivots when said exercise unit is in its first and second exercise positions.

9. An exercise station comprising:

a frame having an elevated support at a front end;

a load unit and an exercise unit swing-mounted on said support for relative swinging movement on the same swing axis, said exercise unit having a raised exercising position for performing a first exercise and a lower exercise position for performing a second exercise, performing of said exercises causing swinging of said exercise unit in the same exercising direction;

a cable attached to said load unit for transferring a load to the load unit to resist swinging movement of the load unit in said exercising direction; and a linkage spaced from said swing axis and constantly interconnecting said units such that when said exercises are performed swinging movement of said exercise unit in the exercising direction is resisted via said linkage by the load on said load unit from said cable, said linkage having an extended condition when the first exercise is performed, and having a folded position when said second exercise is performed whereby said exercise units can be operated in said alternative exercise positions.

10. An exercise station according to claim 9 in which said linkage is;

a two-bar linkage pivotally connected at opposite ends to said exercise unit and load unit at first and second pivot axes, respectively, and movable between a folded rearwardly directed condition when said exercise unit is in its lowered position, and an extended condition when said exercise unit is in its raised position.

11. An exercise station according to claim 10 in which said linkage has an elbow pivot between its two bars which has a pivot axis located in respective over-center positions behind respective imaginary straight lines through said first and second axes when said exercise unit is in its said positions to thereby keep said exercise unit in the selected of said positions so that said exercise unit will be constantly coupled by said linkage to said load unit.

12. An exercise station according to claim 9 in which said linkage is a two-bar linkage which is in respective over-center positions when said exercise unit is in said exercise positions.

13. An exercise station according to claim 12 in which there is a spring extending between said linkage and said exercise unit for biasing said linkage into said over-center positions corresponding to said raised and lowered positions of said exercise unit.

14. An exercise station according to claim 12 in which there is a lever connected to said exercise unit for selectively manually swinging said linkage out of said over-center positions so that said exercise unit is then free to be moved between said raised and lowered positions independently of said load unit.

15. An exercise station comprising:

a body support having an upwardly projecting post at an elevated front end;

a load unit and an exercise unit swing-mounted on said post on the same swing axis for movement relative to one another in front of said body support, said exercise unit having a raised position for a leg curl exercise and having a lowered position for a leg extension exercise;

a two-bar linkage pivotally connected at opposite ends to said exercise unit and load unit at first and second pivot axes, respectively, and movable between a folded rearwardly directed condition when said exercise unit is in its lowered position, and an extended condition when said exercise unit is in its raised position;

said linkage having an elbow pivot between its two bars which has a pivot axis located in respective over center positions behind respective imaginary straight lines through said first and second axes when said exercise unit is in its said positions to thereby keep said exercise unit in the selected of said positions so that said exercise unit will be constantly coupled by said linkage to said load unit;

a spring extending between said linkage and said exercise unit for biasing said linkage into said over-center positions corresponding to said raised and lowered positions of said exercise unit; and a lever connected to said exercise unit for selectively manually swinging said linkage out of said over-center positions in opposition to the bias of said spring so that said exercise unit is then free to be moved between said raised and lowered positions independently of said load unit.

16. An exercise station according to claim 15 in which said lever is connected to said linkage at the pivotal connection of the linkage with said exercise unit.

17. An exercise machine according to claim 15 in which said load unit has a rearwardly extending guide track at its lower end arranged to receive a loaded cable connected to said load unit responsive to forward swinging movement of said load unit caused by swing movement of said exercise unit when said exercises are performed.

18. An exercise station according to claim 15 in which said first bar has a forwardly offset portion arranged to engage the pivot of said second bar as a stop when said linkage is in folded position.

19. An exercise station according to claim 15 in which said load unit has a front-to-back elongated opening along an outer portion of its length through which said linkage extends when the linkage is in folded position.

20. An exercise machine according to claim 19 in which said elongated opening is bridged by a pin on which said second linkage bar mounted by way of a tubular journal, said journal being arranged to be engaged as a stop by said first bar when the linkage is in folded position, said pin being located forwardly of an imaginary straight line extending between the elbow pivot and said first pivot axis when the linkage is in folded position.

21. An exercise machine according to claim 15 in which said exercise unit has a pair of oppositely extending padded arms for leg engagement when said exercises are being performed.

* * * * *